US006630292B2

(12) United States Patent
Bögels

(10) Patent No.: US 6,630,292 B2
(45) Date of Patent: Oct. 7, 2003

(54) METHOD FOR PRODUCING A SILVER HALIDE PHOTOGRAPHIC EMULSION

(75) Inventor: Gertjan Bögels, Tilburg (NL)

(73) Assignee: Fuji Photo Film B.V., Tilburg (NL)

( * ) Notice: Subject to any disclaimer, the term of this patent is extended or adjusted under 35 U.S.C. 154(b) by 0 days.

(21) Appl. No.: 09/841,618

(22) Filed: Apr. 24, 2001

(65) Prior Publication Data

US 2002/0012890 A1 Jan. 31, 2002

(30) Foreign Application Priority Data

Apr. 25, 2000 (EP) ..... 00201472

(51) Int. Cl.[7] ..... G03C 1/005
(52) U.S. Cl. ..... 430/569; 430/567
(58) Field of Search ..... 430/567, 569

(56) References Cited

U.S. PATENT DOCUMENTS

| | | | | | |
|---|---|---|---|---|---|
| 4,801,523 | A | * | 1/1989 | Tufano | 430/589 |
| 4,804,621 | A | | 2/1989 | Tufano et al. | |
| 4,942,120 | A | * | 7/1990 | King et al. | 430/567 |
| 4,983,508 | A | | 1/1991 | Ishiguro et al. | |
| 5,061,617 | A | | 10/1991 | Maskasky | |
| 5,221,602 | A | | 6/1993 | Maskasky | |
| 5,286,621 | A | | 2/1994 | Verbeeck | |
| 5,411,851 | A | | 5/1995 | Maskasky | |
| 5,411,853 | A | * | 5/1995 | Maskasky | 430/569 |
| 5,418,124 | A | | 5/1995 | Suga et al. | |
| 5,418,125 | A | | 5/1995 | Maskasky | |
| 5,482,826 | A | | 1/1996 | Okamura et al. | |
| 5,494,788 | A | * | 2/1996 | Chang et al. | 430/567 |
| 5,496,694 | A | * | 3/1996 | Kikuchi et al. | 430/567 |
| 5,498,516 | A | | 3/1996 | Kikuchi et al. | |
| 5,508,160 | A | * | 4/1996 | Maskasky | 430/567 |
| 5,601,969 | A | * | 2/1997 | Verbeeck | 430/569 |
| 5,667,949 | A | * | 9/1997 | Szajewski | 430/489 |
| 5,750,324 | A | * | 5/1998 | Mydlarz et al. | 430/567 |
| 5,750,325 | A | * | 5/1998 | Szajewski | 430/567 |
| 5,804,363 | A | * | 9/1998 | Maskasky et al. | 430/567 |
| 5,879,874 | A | | 3/1999 | Maskasky et al. | |
| 5,998,124 | A | | 12/1999 | Ohzeki et al. | |
| 6,010,840 | A | * | 1/2000 | Verrept et al. | 430/567 |
| 6,022,681 | A | * | 2/2000 | Hosoya et al. | 430/569 |
| 6,030,762 | A | * | 2/2000 | Verrept et al. | 430/567 |
| 6,087,085 | A | * | 7/2000 | Elst | 430/567 |

FOREIGN PATENT DOCUMENTS

| | | |
|---|---|---|
| EP | 0 561 415 | 9/1993 |
| EP | 0 651 284 | 5/1995 |
| EP | 0 694 809 | 1/1996 |
| EP | 0 701 166 | 3/1996 |

* cited by examiner

*Primary Examiner*—Janet Baxter
*Assistant Examiner*—Amanda C Walke
(74) *Attorney, Agent, or Firm*—Merchant & Gould, P.C.

(57) ABSTRACT

The invention is directed to a method for producing a silver halide photographic emulsion comprising the step of reacting a water-soluble silver salt and at least one water-soluble halide salt containing chloride or bromide in aqueous solution in the presence of an organic Grain Growth Modifier (GGM) compound, containing a halide X, which halide is not released in the form of an ion, to form light-sensitive silver halide grains having a silver halide content of a least 50 mole %, said grain growth modifier compound being water-soluble with a solubility>4 mmole per liter, and being selected from the group of compounds with an aliphatic or cyclo-aliphatic backbone R to which is attached one or more halide groups and at least one polar group.

25 Claims, 3 Drawing Sheets

1 = Addition of reagents ± 1 min.
2 = Addition of GGM after nucleation
3 = Physical ripening
4 = Ostwald ripening (2–17 hours)

METHOD FOR PRODUCING A SILVER HALIDE PHOTOGRAPHIC EMULSION

BACKGROUND OF THE INVENTION

The present invention is directed to improvements in the silver halide based photography.

The principle of silver halide photography is based on the activation of silver halide grains by light. A method to reduce the amount of silver present, without loss of the specific surface area of the grains in the photographic layers, is realisable by the use of tabular grains. Tabular grains in general (for which the diameter is considerably larger than the thickness) are also preferred for raising the speed of a silver halide emulsion for photographic purposes, increasing sharpness, and improving graininess, colour sensitivity efficiency with sensitising dyes and covering power. The high bromide {111} tabular grains are commonly used in the photographic industry. Still, there is a need to produce tabular crystals with a high aspect ratio and a narrow size distribution. A Grain Growth Modifiers (GGM) can narrow the size distribution and increase the aspect ratio.

Definitions

In the present description the following terms and definitions are used.

In referring to grains and emulsions containing one or more halides, the halides are named in order of ascending concentrations The term "high chloride" in referring to grains and emulsions indicates that chloride is present in a concentration of greater than 50 mole percent, based on total silver.

The term "high bromide" in referring to grains and emulsions indicates that bromide is present in a concentration of greater than 50 mole percent, based on total silver.

The term "equivalent circular diameter" or "ECD" is employed to indicate the diameter of a circle having the same projected area as the silver halide grain.

The term "aspect ratio" designates the ratio of the grain ECD to the grain thickness.

The term "tabular grain" indicates a grain having two parallel grain faces which are clearly larger than any remaining grain face and an aspect ratio of at least 2.

The term "tabular grain emulsion" refers to an emulsion in which tabular grains account for greater than 50 percent of the total grain projected area.

The term "{111} tabular" is employed in referring to tabular grain emulsions containing tabular grains having {111} major faces.

Octahedral grains with respect to high chloride-containing grains means eight-sided silver chloride-containing grains whose exterior crystal faces lie in {111} crystallographic planes and are normal to axes of trigonal symmetry.

The term "pBr"=$-\log[Br^-]$

Cubo-octahedral grains with respect to high silver chloride-containing grains means fourteen-sided silver chloride-containing grains of which eight of the exterior crystal faces lie in {111} crystallographic planes and six of the exterior crystal faces lie in {100} crystallographic planes.

The grain making process is: the process of making grains that contains at least the nucleation phase (reacting a water-soluble silver salt and at least one water-soluble halide salt) and optional ripening and/or growth phases (addition of reagents).

Water Solubility: values are given at 25 degrees C. or at the nearest temperature to this where data are available. The solubility of solids is defined as the concentration of the compound in a solution that is in equilibrium with the solid phase at the specified temperature and one atmosphere pressure. For liquids whose water mixtures separate into two phases, the solubility given here is the concentration of the compound in the water-riche phase at equilibrium.

High chloride {111} crystal surfaces ({111} tabular and octahedral grains) can only be produced in the presence of a GGM. The reason for this is that high silver chloride {111} crystal surfaces, unlike high bromide {111} crystal surfaces, cannot be formed or maintained in the absence of a GGM, but rather take cubic forms, since {100} crystal faces are more stable in high silver chloride grains High chloride grains with {111} crystal surfaces are of practical importance because they present a unique surface arrangement of silver and halide ions, which in turn influence the grain surface reaction and adsorption typically encountered in photographic applications. For high chloride {111} tabular grains a shortening of processing time is greatly desired and there is an urgent need for the development of silver halide.

GGM can be used to increase the aspect ratio for high bromide silver halide grain emulsions and to form tabular- and octahedral grains for high chloride silver halide grain emulsions.

The technology used presently in the prior art methods can be divided in three main groups:

According to the first method, high bromide {111} tabular grain emulsions are used.

The preparation of high bromide {111} tabular grain emulsions with the aid of GGM is mainly described in the patents: U.S. Pat. No. 5,411,851 (and EP 0,701,166); U.S. Pat. Nos. 5,411,853 and 6,418,125

In all these patents the composition of the {111} tabular grains depends on the composition of the grains from the initial crystallisation process, which is the nucleation phase. The patent (U.S. Pat. No. 5,411,851) disclose a method in which the ripened grains will be tabular, independent of the initial shape of the grains, when the initial thickness of the tabular grains after the nucleation phase is 0.06 $\mu$m or less. During the nucleation phase the pBr is about 3.8. No additions of chemical reagents (silver nitrate nor potassium bromide) are performed to the reaction chamber after the nucleation phase, except for pH- and pBr-correction (e.g. pH=5.0 and pBr≈3.1). This means that the composition of the grain is determined by the reagents additions during the nucleation phase and can not be steered in one of the ripening phases (=physical- and/or Ostwald-ripening phases).

The main aspects of these known processes are:

U.S. Pat. No. 5,411,851: The GGM used in this patent are: tri-amino pyrimidine derivatives. The temperature during the nucleation phase is: =15° C., and the pH range is: 4.6<pH<9.0.

U.S. Pat. No. 5,411,853 and EP 0,701,166: The GGM used in these patents are poly iodo phenol derivatives. The temperature during the nucleation phase is: 40° C., and the pH range is: 1.5<pH<8.

U.S. Pat. No. 5,418,125: The GGM used in this patent are: hydroxy quinoline derivatives. The temperature during the nucleation phase is: =40° C., and the pH range is: 2<pH<8.

According to Maskasky (U.S. Pat. Nos. 5,418,125; 5,411,851; 5,411,853 and EP 0 701 166 A1) it not understand why the grain growth process with double-jet precipitation of chemical reagents employing this grain growth modifiers are less effective than the grain growth process of his invention.

The process as described in prior art patents from Maeskssy is schematically described in FIG. 1.

The main disadvantages, for Maskasky's system, as compared to the commonly used double-jet precipitation method, are:

1. The process described by Maskasky has only a nucleation stage in which silver and halide reagents are added. This implies that no grains with a shell layer having different halide compositions can be formed. Those core/shell grains are commonly employed in all photographic products because each layer can add to the unique photographic properties of the product. Therefore the double-jet method gives a better control over the crystal growth making process in which the photographic properties can be maximally utilised.

2. The used GGM are in general not very well soluble in water and can only be removed from the grains with special solvents and/or reduction of the pH (protonation), U.S. Pat. No. 5,418,125. The incomplete removal of the GGM from the grain surface will negatively influence the photographic properties. This will give an emulsion with higher fog or lower sensitivity. This is because spectral sensitizers can not effectively form aggregates onto the grain surface.

3. The manufacturing time to produce {111} tabular grains is increased from 1½–2 hour (for the double-jet precipitation method) to 2–17 hours.

The second method concerns the use of high chloride tabular grain emulsions

Without addition of GGM, silver chloride grains have {100} major faces, which lead to the formation of mainly cubic grains. With the addition of GGM, tabular silver chloride grains having {111} major faces are formed and the aspect ratio or, other grain properties of {111} tabular grains will depend on the GGM used. This is described in the following patents:

EPO 0 694 809 A1: The GGM used are phenol derivatives Because the water solubility of the phenol derivates is too low, a co-solvent has to be used for the addition of the GGM.

U.S. Pat. No. 4,804,621: The GGM used are amino pyrimidine derivatives. {111} tabular grains are formed with aspect ratios ranging from 5 till 9.

As the properties required for the crystal habit controlling agents, it is particularly important that the crystal habit controlling agent does not reduce the photographic sensitivity and does not hinder the adsorption of dyes for spectral sensitisation In this point, the use of the pyrimidines is undesirable The additionally used ammonia is increasing the solubility of the silver halide grains and makes it difficult to produce the practically useful small-sized tabular grains.

U.S. Pat. No. 4,983,508: The GGM used pyridine derivatives. Only 30% of the grains formed are tabular. The grains are suitable for rapid development processing with reduced fog.

U.S. Pat. No. 5,061,617: {111} tabular grains are formed with aspect ratios varying from 9 till 16, while the percentage of tabular grains vary from 30 till 70% with thiocyanate as GGM. However, a thiocyanate increases the solubility of silver chloride grains as the case of using ammonia.

U.S. Pat. No. 5,221,602: The GGM used are hydroaminoazines. Because the water solubility of the GGM is so low a co-solvent has be used for the addition of the GGM. The GGM can only be removed from the grains surface by an extra protonation step.

U.S. Pat. No. 5,286,621: The GGM are adenine derivatives of which adenine ($C_5H_5N_5$) is the most effective. The GGM enhance the formation of {111} tabular silver chloride grains with aspect ratios ranging from 5 till 9. The GGM used are almost insoluble in water and can not be completely removed from the grain surface. In the most ideal case 10% of the adenine is still present on the grain surface after washing the emulsion. This causes a negative influence to the absorption of any spectral sensitisers at the grain surface.

U.S. Pat. No. 5,998,124: The GGM used are slightly water-soluble pyridine derivatives. At least 30% of the total grain projected area are accounted for by grains with {111} major faces.

According to the third method, high chloride octahedral grain emulsions are used.

The use of GGM may lead under specific conditions, like high GGM concentration and low addition rate of the reagents, to the formation of silver chloride grains with mainly octahedral shape. Those grains are bounded by {111} faces. This is described in patent U.S. Pat. No. 4,801,523, for an amino azapyridine as GGM. This GGM is poorly water dissolvable and a co-solvent should be used for the addition. However the low solubility will hinder the removal from the grain surfaces. This type of grains is of special interest for producing mono-disperse grain emulsions. As the properties required for the crystal habit controlling agents, it is particularly important that the crystal habit controlling agent does not reduce the photographic sensitivity and does not hinder the adsorption of dyes for spectral sensitisation. In this point, the use of the pyrimidines is undesirable.

For U.S. Pat. No. 5,221,602; EPO 0 694 809 A1; U.S. Pat. Nos. 4,983,508 and 5,286,621 the GGM are almost insoluble in water. Therefore, the interaction with the grain surface will be high and removal from the surface will be a problem which is illustrated by the incomplete removal of the GGM from the surface (U.S. Pat. No. 5,286,621) or the requirement of an additional step to remove the GGM from the surface (U.S. Pat. No. 5,221,602)

The patents: EP 0 651 284 A1; EP 0 561 415 A1, U.S. Pat. Nos. 5,879,874; 5,498,516; 5,482,826 and 5,418,124 disclose organic iodide compounds, that release very easily the iodide ion(s) at a certain pH, in reaction with a nucleophilic molecule, such that the iodide ion form together with silver a silver iodide layer onto the grains. In these iodide releasing stages no increase of the aspect ratio occur.

SUMMARY OF THE INVENTION

The present invention is primarily based on the usage of a grain growth modifier compound with a hydrocarbon backbone to which are attached one or more halide groups and at least one polar group (to increase the solubility). The other atoms/groups to the back bone can be freely chosen as far as they do not decrease the solubility too much This compound will be used as GGM for the preparation of silver halide {111} tabular and/or octahedral grain emulsions.

Another aspect of the invention is the formation of {111} tabular grains for high bromide emulsions with an increased aspect ratio of more than 4 and a more narrow grain size distribution wherein at least 50% of the total grain population are high bromide {111} tabular grains.

Still another aspect of the invention is the formation of high chloride {111} tabular grain emulsions with an aspect ratio of more than 3, using these good water-soluble GGM wherein at least 50% of the total grain population are silver chloride {111} tabular grains.

A further aspect of the invention is the preparation of high chloride silver halide emulsions {111} with octahedral grains wherein at least 50% of the total grain population are octahedral silver halide grains.

The present invention is accordingly directed to a method for producing a silver halide photographic emulsion comprising the step of reacting a water-soluble silver salt and at least one water-soluble halide salt containing chloride or bromide in aqueous solution in the presence of an organic Grain Growth Modifier (GGM) compound, containing a halide X, which halide is not released in the form of an ion, to form light-sensitive silver halide grains having a silver halide content of a least 50 mole %, said grain growth modifier compound being water-soluble with a solubility>4 mmole per liter, and being selected from the group of compounds with a hydrocarbon backbone R to which is attached one or more halide groups and at least one polar group.

Other aspects and advantages of the present invention will become apparent from the following descriptions, taken into connection with the accompanying drawings, wherein, by way of illustration and example, an embodiment of the present invention is disclosed.

BRIEF DESCRIPTION OF THE INVENTION

DETAILED DESCRIPTION OF THE INVENTION

To satisfy the objective of a silver halide {111} tabular grain emulsion with a high percentage of tabular grains, the invention is directed to increase the aspect ratio of the tabular grains of high bromide silver halide {111} tabular grain emulsions and for high chloride silver halide {111} grains to create high chloride silver halide {111} tabular grains or high chloride silver halide {111} octahedral grains, by the introduction of a GGM in the nucleation and/or chemical ripening process and/or growth processes of the silver halides.

The GGM used in accordance with the present invention have the advantage that the relative growth rate of the tabular {111} faces decreases as compared to the growth rate of the crystal sides. As a consequence the grain growth modifier is efficient for increasing the aspect ratio of the tabular grains, which is defined as the ratio between the ECD and thickness t of the tabular grain. At some specific nucleation and/or growth conditions the aspect ratios of the tabular grains increases from 20 to 60% when the present grain growth modifiers are used as compared with the processes where no GGM are present.

One of the surprising aspects of this invention is that the specific GGM are effective to produce high bromide {111} tabular grain emulsions with increased aspect ratios when the double-, or triple-jet precipitation process is applied Various prior-art patents concerning high bromide tabular grains are disclosed with GGM in which the double jet-precipitation method could not be applied to increase the aspect ratio using a GGM. Because For these prior-art patents it was not possible to add the reagents silver nitrate and/or potassium halide solutions or other additive emulsion compounds during the grain growth process. With this invention it is possible to introduce the basic reagents silver nitrate and potassium halide solutions and other specific compounds (like chemical and spectral sensitisers etc.), also during the grain growth process with the double-jet precipitation methods.

Figure 1:
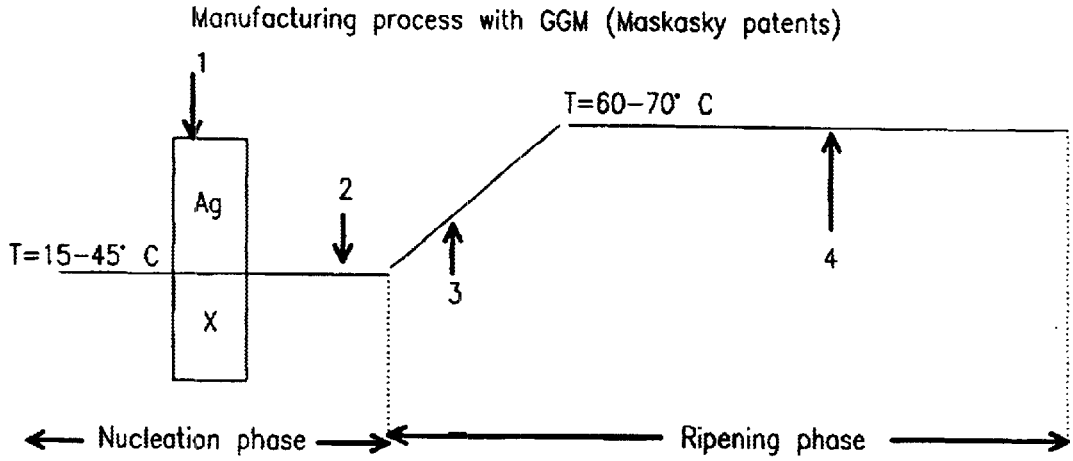
FIG.1 (Prior Art)
FIG. 1 depicts a manufacturing process with grain growth modifiers (GGM).
Figure 2:
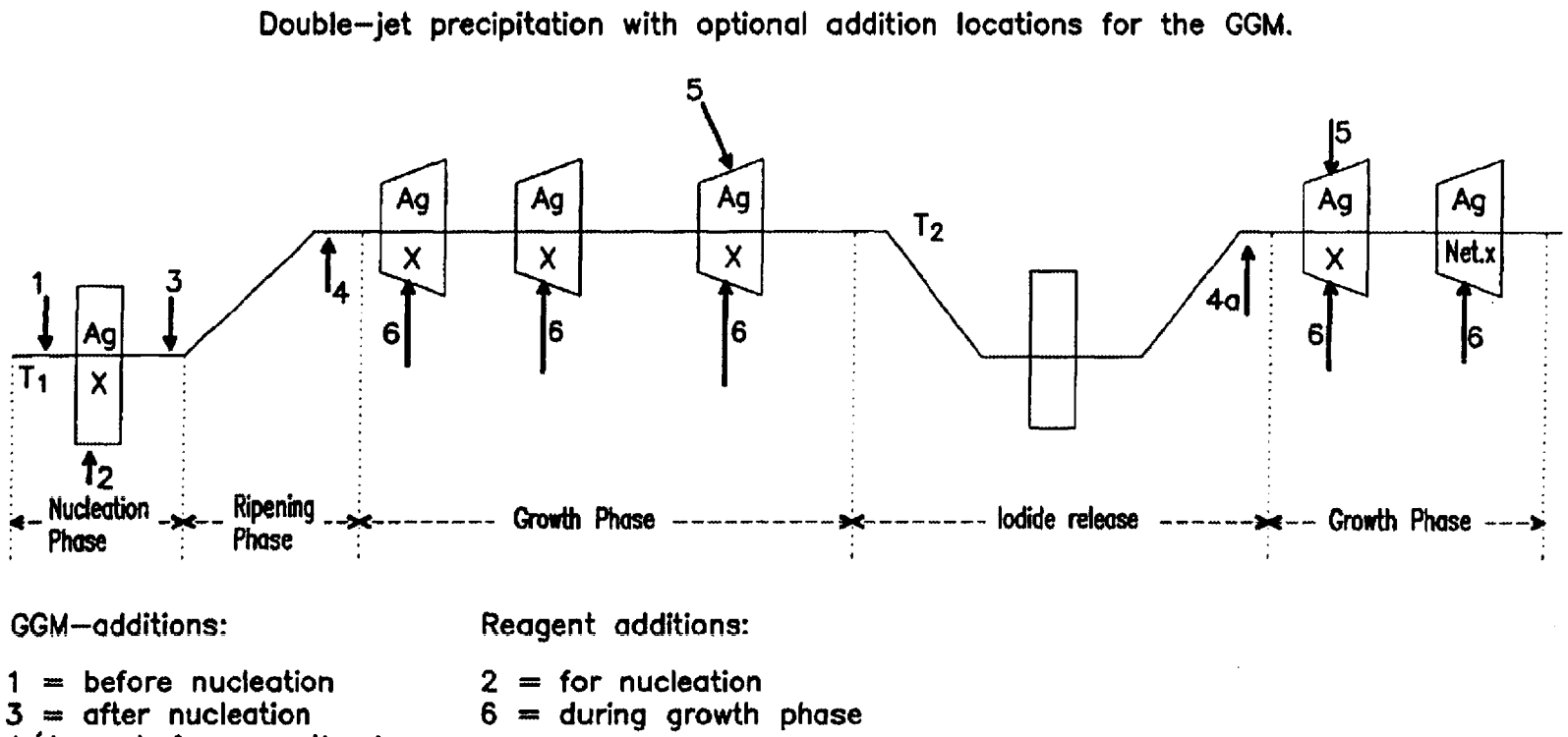
FIG. 2 depicts double - jet precipitation with optional addition locations for the grain growth modifier (GGM).

In the present invention, the GGM can be introduced in the disperse medium of a halide, water and a peptiser before the reagents silver nitrate and potassium bromide are added by a double-jet precipitation method in the nucleation process. However the GGM can also be introduced during the nucleation process together with the nucleation reagents. In order to get benefits also during the physical- and chemical ripening stages the GGM is introduced after the nucleation process and/or during the various stages of the chemical ripening. (see FIG. 2)

In case seed crystals of precipitated silver halides are used, the aspect ratio of the tabular grains will also increase more when the GGM added before or after the introduction of seed grains. The GGM can also be added during the growth processing in which the composition and the crystal growth can be controlled when the GGM is introduced just before the reagents silver nitrate and potassium halides are added optionally together with other chemical compounds (like spectral sensitisers etc.). Finally the tabular grains are washed with water in order to remove the excess of salts and gelatine but also the GGM at the grain surface which hence is preferably good dissolvable in water. If the GGM is not good soluble in water, the remaining GGM species will compete with special compounds like spectral sensitisers which are also adsorbed at the crystal surfaces in one of the next steps of the photosensitive emulsion manufacturing process.

A further surprising observation of this invention is that high chloride {111} tabular grain emulsions can be obtained, when the GGM is added in the disperse medium before the start of the nucleation stage. Owing the good solubility of the GGM of this invention the GGM will be easily washed of the grain surfaces, thus, no extra wash steps are needed and no decrease of the photographic properties are present, as was reported in various prior art patents.

The present invention is preferably directed to a method for producing a silver halide photographic emulsion comprising the step of reacting a water-soluble silver salt and at least one water-soluble halide salt containing chloride or bromide in aqueous solution in the presence of a Grain Growth Modifier (GGM) compound, to form light-sensitive silver halide grains having a silver chloride content of a least 50 mole %, selected from octahedral grains, cubo-octahedral grains and tabular grains wherein at least 30% of the surface area of said light-sensitive silver halide grains is composed of {111} planes, a silver bromide content of a least 50 mole %, selected from tabular grains wherein at least 70% of the surface area of said light -sensitive silver halide grains is composed of {111} planes, said grain growth modifier compound being water-soluble with a solubility>4 mmole per liter, and being selected form the group of compounds with a hydrocarbon backbone R to which is attached one or more halide groups and at least one polar group. If the solubility of GGM is <4 mmole/l the average aspect ratio will decline and the desorption of GGM-molecules from the grain will be poorer too, which influences the photographic properties in a negative way.

The GGM compound is preferably represented by formulae (I) or (II):

$$(RX_n)Y_m \quad \text{(I)}$$

$$(Y_pRX_n)Z(Y_qRX_r) \quad \text{(II)}$$

wherein R is a hydrocarbon backbone to which is attached one or more halide $X_n$-groups (n=1–4 and/or r=1–4) the other atoms/groups attached to the back bone can be freely chosen. For formula (I) at least one polar $Y_m$-group (m=1–3) is attached to the backbone. For formula (II) the two hydrocarbon backbones R are attached by one polar group Z. To each hydrocarbon backbone can be attached at least one polar $Y_p$-, or $Y_q$-group; p,q=0,1,2):

The hydrocarbon R-group can be aliphatic, or cyclo-aliphatic. This excludes the aromatic and heterocyclic compounds. In case of the use of non-cyclic compounds, preferably aliphatic, they can contain up to 6 C-atoms but preferably less than 3 C-atoms, while most preferably 1 C-atom is required.

The halide $X_n$-group can be composed of more than 1 halide atom and preferably between 1 and 3 atoms; the halide group consists of iodide-, bromide-, chloride- or fluoride-ions. The halide group is responsible for the 'weak' adsorption at the surface of the precipitated crystals; the iodide-group is the most preferable halide group. The number of halide groups in the preferred molecular structure of the GGM can vary, preferably between 1 and 3.

In order to increase the solubility of the GGM polar hydrocarbon Y- and Z-groups are designed in the molecular structure. The polar groups take care that the GGM are easily soluble in the water washing process which is usually carried out at the end of the double-jet precipitation method in order to remove salts and the disperse peptiser medium. In order to make the GGM good soluble in water specific Y-groups are selected from polar entities like —$CONH_2$, —COOH, —$COSO_2$—$COSO_3H$, —COH, —CONHOH, —CN, —SCN, —$CONO_2$, —COSH, —$COSO_2NH_2$, or —$COCH_3$ groups.

The polar Z-groups are selected from polar entities like: —(C═O)—O—(C═O)—, —(C═O)— or —O—, —(C═NH)—, —(CH—$NH_2$)—.

The most preferred GGM structures are 2-Iodoacetamide and 2-Iodoacetic and 2-Idoacetic acid, because these compounds are well dissolvable in water and the iodide-atoms are weakly adsorbed at the crystal faces.

In our invention the organic halide compound remains intact in the emulsion, i.e. the halide is not released as an ion, either during production of the emulsion, or during the subsequent use thereof, and is completely removed from the silver halide grain surface as molecule during the washing phase.

However, both aspects of the solubility in water by the Y-group and the halide interaction with the crystal surfaces can be varied in different ways e.g. the poorer solubility of larger hydrocarbon molecules with more C-atoms can be compensated by adding one or more polar Y-compounds at the hydrocarbon chain while also the adsorption characteristics can be varied by introducing one or more halide groups at the larger hydrocarbon chain From the examples more practical solutions can be imagined on which the molecular structure of the GGM is based upon.

Figure 3:
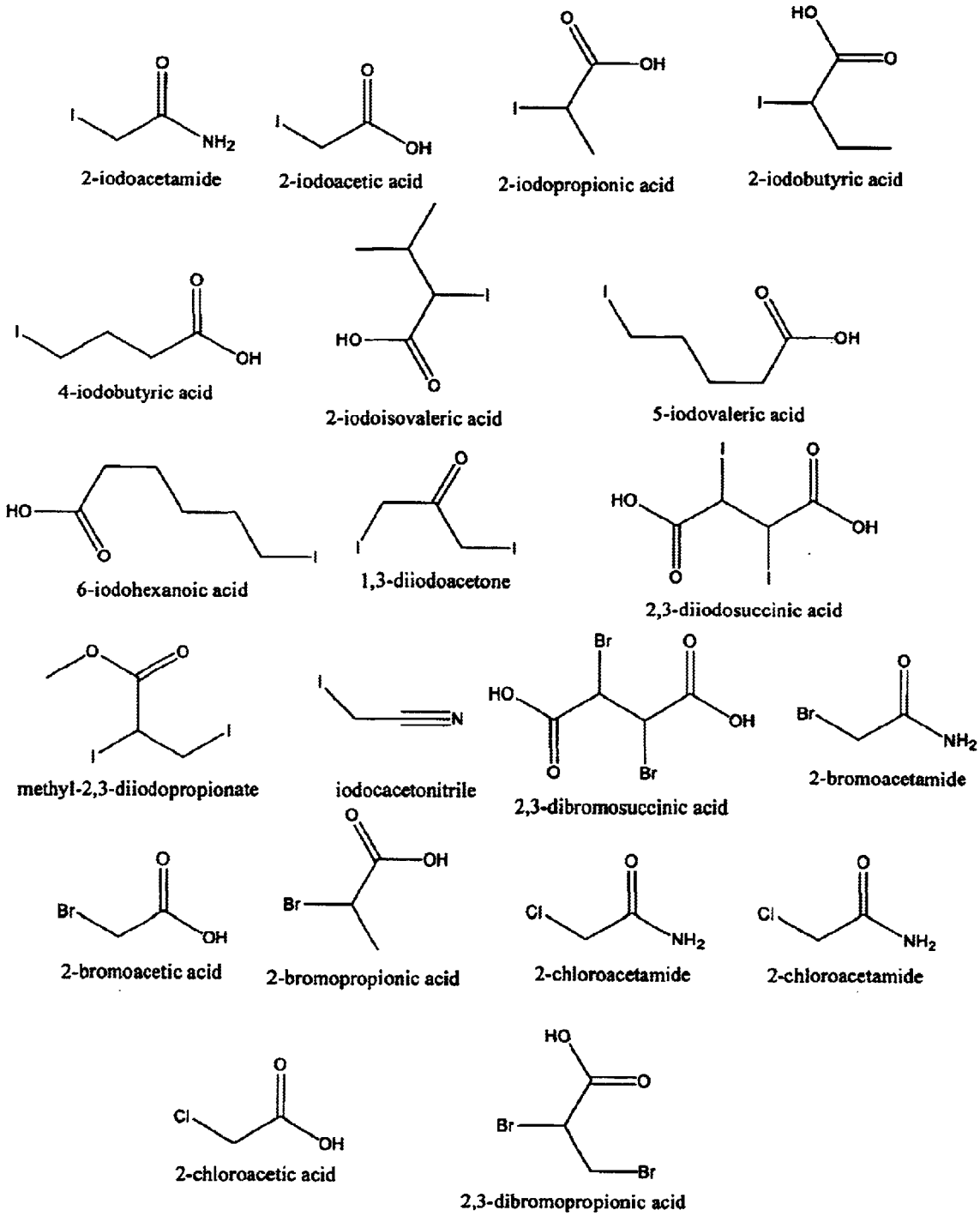
FIG. 3 depicts an overview of grain growth modifiers (GGM).

Specific examples of compounds represented by the molecular structure of formulae I and II are shown in FIG. 3, but the invention is not to be construed as being limited to the use of these compounds.

In practise small differences in the chloride concentrations will result in different crystal structures:

1. Preparation of Tabular Grains With High Chloride Emulsions

To an aqueous solution containing chloride and gelatine, a GGM compound is added and subsequently the reagents silver nitrate and potassium chloride are added to in the nucleation phase such that nuclei of silver chloride grains are formed.

The concentration of chloride in the nucleation phase is between 0.05 and 5 mole/liter, preferably between 0.07 and 2 mole/liter and most desirably between 0.15 and 0.5 mole/liter. After the formation of these silver chloride nuclei more GGM compound of this invention is added to the solution for the grain growth process. During this grain growth process the chloride concentration is not more than 5 mole/liter and preferably between 0.1 and 2 mole/liter.

After the grain growth process a solution of methanol and water containing spectral sensitiser compounds is added. By increasing the temperature up to 75° C. the GGM at the grain surface is-exchanged with the spectral sensitiser. Finally the grains are washed with water to remove the excess of salts, GGM and gelatine. For stabilisation of {111} surfaces, other chemicals can be used too, e.g. anti-foggants and inorganic salts.

2. Preparation of Regular Crystalline (Octahedral and Tetra Decahedral )Grains

To an aqueous solution containing chloride and gelatine, a GGM compound of this invention is added and subsequently the reagents silver nitrate and potassium chloride are added to in the nucleation phase such that nuclei of silver chloride grains without twin planes are formed.

The concentration of chloride in the nucleation phase is not more than 0.5 mole/liter, preferably between 0.02 and 0.22 mole/liter and most desirably between 0.05 and 0.1 mole/liter. After the formation of these silver chloride nuclei more GGM compound of this invention is added to the solution for the grain growth process. During this grain growth process the chloride concentration is not more than 5 mole/liter and preferably between 0.07 and 2 mole/liter.

The high chloride tabular grains of this invention have surfaces consisting of {111} planes and at least 30% of the whole surface, preferably at least 40% of the whole surface and most desirably at least 60% of the whole surface consists of {111} planes. The estimation of the area of {111} planes can be achieved from electron micro graphs of the silver halide grains.

The high bromide tabular grains of this invention have surfaces consisting of {111} planes and at least 60% of the whole surface, preferably at least 70% of the whole surface and most desirably at least 90% of the whole surface consists of {111} planes.

The aqueous disperse medium before the nucleation process is composed of a halide) water and a peptiser which usually is a protein compound like gelatine. However also the following compounds are used as peptisers like: collagen, protein, poly peptides, gelatine, gelatine peptiser The peptiser typically contains from about 1 to 6 wt % based on the total weight of the aqueous disperse medium.

The gelatine peptiser consists of gelatine molecules selected from the group consisting of natural gelatine, alkaline processed gelatine, acid processed gelatine, hydrolysed gelatine, peptised gelatine resulting from enzymatic treatment, chemically modified gelatine and recombinant gelatine.

The temperature during the formation of the grains can be within the range from 10° C. to 95° C. and is preferably within the range from 10° C. to 50° C.

The pH of the aqueous disperse medium in the nucleation process ranges from 2 to 10, preferably from 3 to 7. The pH can be adjusted if required with a strong mineral base such as alkali hydroxide or a strong mineral acid such as nitric acid or sulphuric acid. Ammonium hydroxide should not be used because the ammonium ions will act as ripening agents which will increase the grain thickness.

During the manufacturing of tabular grains with high bromide emulsions the bromide concentrations has to be properly controlled by the pBr in the various phases of the crystal formation. The pBr of the disperse medium is controlled by alkali bromide and silver nitrate additions.

The pBr in the Ostwald ripening phase is controlled between 3.1 and 1.0, while the pBr in the growth phase is controlled usually between 3.2 and 0.9.

The grain size distribution of the high bromide tabular grains of this invention may be poly disperse or mono disperse but mono dispersion is preferred. If the pBr of the growth process is lowered, the aspect ratio of the tabular grains will be increased. At a pBr below 2.15 the mono dispersity of the emulsion significantly decreases. One of the other surprising discoveries of this invention is shown in one of the examples below wherein the mono-dispersity of the grain distribution improves significantly when the invented grain growth molecules are added before and during the crystal growth process is carried out below 2.15. Preferably the pBr for this growth process with improved mono-dispersity ranges between 2.15 and 0.8.

In photographic emulsions which contain a high chloride content in the silver halide grains of this invention, the grains are preferably having a chloride content of at least 50%, preferably at least 70% and most desirably at least 90%.

In photographic emulsions which contain a high bromide content in the silver halide tabular grains of this invention, the grains are preferably having a bromide content of at least 50%, preferably at least 70% and most desirably at least 90%.

When photographic emulsions of this invention are used in the form of a mixture with other photographic emulsions, then the mixed emulsion can be preferably a high chloride emulsion which contains at least 70 mole % of silver chloride. However in case a high bromide emulsion is preferred, it will contain at least 90 mole % of silver bromide.

The concentration of the GGM for the high bromide tabular grains ranges from 0.005 to 500 mmole GGM per mole of silver, preferably between 0.05 and 100 mmole GGM/mole silver. Addition of too much GGM will result in tabular grains with decreased aspect ratio and finally re-nucleation can occur after more GGM is added.

In case of high chloride tabular grains the concentration of added GGM ranges from 0.01 to 3.0 mole GGM per mole of silver, preferably between 0.1 and 2.0 mole GGM/mole silver.

In case high chloride octahedral crystals are manufactured the concentration of added GGM ranges from 0.01 to 3 mole GGM per mole of silver, preferably between 0.1 and 2.0 mole GGM/mole silver.

Silver halide emulsions prepared in accordance with this invention can be used in either colour photographic materials or black-and-white photographic materials or movie-film materials. Examples of colour photographic materials include colour papers, films for colour photography, colour reversal films and examples of black-and-white materials including X-ray films, films for printing sensitive materials etc.

The invented grain growth modifiers which contain iodide-ions as halide ions can also be applied as iodide-ion-releasing compounds as is disclosed in U.S. Pat. No. 5,482,826. These compounds are added usually at the end of the grain making process before the crystals are washed, but can be added also between two growth steps. The ion-releasing compounds are applied at higher concentrations than in our invention of the grain growth modifier compounds. The Iodide releasing compounds will not increase the aspect ratio of the silver bromide {111} tabular grains (as the GGM does in our invention) but will release his iodide group after the subsequent additions of the Iodide releasing compound and an active nucleophilic agent. In the Iodide releasing stage the aspect ratio of the grains is not increased but a homogeneous layer of silver iodide is formed onto the core grain surface. The molecule of which the Iodide is released will be stay in the reaction mixture, however, it is not effective as grain growth modifier.

The iodide-ion-releasing compound is a compound that releases an iodide-ion by a reaction with a nucleophilic reagent for which the following chemical species are preferred: a hydroxide ion, a sulfite ion, hydroxylamine, a thiosulfate ion, a metabisulfite ion, hydroxamic acids, oximes, dihydroxybenzenes, mercaptans, sulfinic acids, carboxylic acids, ammonia, amines, alcohol's, urea's, thiourea's, phenols, hydrazides, semicarbazides, phosphines and sulphides.

The speed by which the iodide-ion is released from the iodide-ion-release agent is pH controlled, preferably by the addition of an alkali hydroxide.

The concentration range, at which the iodide-ion-release agent optimally reacts with a nucleophilic agent, producing free iodide ions, is from $10^{-7}$ to 20 mole/l and most preferably from $10^{-3}$ to 2 mole/l.

The preferred amount of iodide ions, released from the iodide-ion-release agent, ranges from 0.1 to 20 mole % and particularly preferably from 1 to 10 mole %, based on the total amount of silver.

This iodide-ion-releasing method to produce dislocations at silver halide grains is especially effective, while the iodide-ion release can be steered, so that the iodide-ions are not released until the emulsion is completely homogeneous, resulting in a homogeneous distribution of the dislocations at the edges of said silver halide grains.

Comparable Iodide-containing compounds are deliberately reacted to a nucleophilic agent with the release of the Iodide-ion, as is disclosed in: EP 0,651,284; EP 0,501,415; U.S. Pat. Nos. 5,879,874; 5,498,516 and 5,418,125.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system structure or manner.

The invention is now further elucidated on the basis of the following examples.

EXAMPLES

Emulsion A. Tabular AgBr Grain Emulsion

A stirred reaction vessel contained a 1200 ml of 0.72% by weight gelatine solution in water. The solution was maintained at a temperature of 40 degrees C. To this solution a 0.47 M silver nitrate solution and a 0.82 M potassium bromide solution were added at an identical addition rate of 75.2 ml/min. The addition of potassium bromide was started one second before the addition of the silver nitrate and topped simultaneously after 30 seconds. The temperature was increased to 75 degrees C. and again gelatine was added to bring the percentage by weight of gelatins to 22.4. 1.17 mole of silver nitrate, 1.18 mole of potassium bromide and 0.06 mole of potassium iodide was added during five different growth additions. The pBr of the reaction mixture varied during the different growth phases between 2.69 and 1.88. The additions rate of all additions was so that no re-nucleation occurred during the growth stage.

The grains were washed to remove the excess of salts and gelatine. After the washing 65 g of gelatine was added to the emulsion and the emulsion was stored at 6 degrees C. An $AgBr_{95}I_5$ emulsion grain results from this preparation.

Control test A: (comparative example): High silver bromide {111} tabular grain emulsions for photographic application Emulsion A was prepared as described above. To emulsion A was added 16 ml of water after the nucleation and 30 ml of water before the first addition in the growth phase.

The resulting emulsion contained tabular grains having an average ECD (Equivalent Circular Diameter) of 0.670 μm, an average thickness of 0.149 μm and an average aspect ratio of 4.50. The emulsion parameters are listed in table 1.

Example 1

(Inventive Example): High Bromide {111} Tabular Grain Emulsions for Photographic Application Emulsion A was prepared as described above. To emulsion A was added 16 ml of 0.0167 M of 2-Iodoacetamide solution after the nucleation and 30 ml 0.1 M of 2-Iodoacetamide solution before the first addition in the growth phase (at 75° C.). The resulting emulsion contained tabular grains having an average ECD of 0.809 μm, an average thickness of 0.127 μm and an average aspect ratio of 6.37. The emulsion parameters are listed in table 1.

Example 2

(Inventive Example): High Bromide {111} Tabular Grain Emulsions for Photographic Application Emulsion A was prepared as described above. To emulsion A was added 16 ml of 0.0375 M of 2-Iodoacetamide solution after the nucleation and 30 ml 0.1 M of 2-Iodoacetamide solution before the first addition in the growth phase (at 75° C.). The resulting emulsion contained tabular grains having an average ECD of 0.798 μm, an average thickness of 0.116 μm and an average aspect ratio of 6.88. The emulsion parameters are listed in table 1.

Example 3

(Inventive Example): High Bromide {111} Tabular Grain Emulsions for Photographic Application Emulsion A was prepared as described above. To emulsion A was added 16 ml of 0.0375 M of 2-Iodoacetamide solution after the nucleation and 45 ml 0.4 M 2-Iodoacetamide solution before the first addition in the growth phase (at 75° C.) The resulting emulsion contained tabular grains having an average ECD of 0.789 μm, an average thickness of 0.112 μm and an average aspect ratio of 7.00. The emulsion parameters are listed in table 1.

Example 4

(Inventive Example): High Bromide {111} Tabular Grain Emulsions for Photographic Application Emulsion A was prepared as described above. To emulsion A was added 16 ml of 0.0375 M of 2-Iodoacetamide solution after the nucleation and 60 ml 0.4 M of 2-Iodoacetamide solution before the first addition in the growth phase (at 75° C.) and 80 ml 0.4 M of 2-Iodoacetamide solution before the fourth growth phase. The resulting emulsion contained tabular grains having an average ECD of 0.773 μm, an average thickness of 0.121 μm and an average aspect ratio of 6.39. The emulsion parameters are listed in table 1.

Example 5

(Inventive Example): High Bromide {111} Tabular Grain Emulsions for Photographic Application Emulsion A was prepared as described above. To emulsion A was added) 45 ml 0.4 M of 2-Iodoacetamide before the first addition in the growth phase (at 75° C. solution and 75 ml 0.4 M of 2-Iodoacetamide solution before the fourth growth addition.

The resulting emulsion contained tabular grains having an average ECD of 0.841 μm, an average thickness of 0.128 μm and an average aspect ratio of 6.57. The emulsion parameters are listed in table 1.

Example 6

Inventive Example): High Bromide {111} Tabular Grain Emulsions for Photographic Application Emulsion A was prepared as described above. To emulsion A was added 16 ml of 0.0875 M of 2-Chloroacetamide solution after the nucleation and 45 ml 0.4 M of 2-Chloroacetamide solution before the first addition in the growth phase (at 75° C.). The resulting emulsion contained tabular grains having an average ECD of 0.796 μm, an average thickness of 0.148 μm and an average aspect ratio of 5.87. The emulsion parameters are listed in table 1.

Example 7

(Inventive Example): High Bromide {111} Tabular Grain Emulsions for Photographic Application Emulsion A was prepared as described above. To emulsion A was added 16 ml of 0.0875 M of 2-Bromoacetamide solution after the nucleation and 45 ml 0.4 M of 2-Bromoacetamide solution before the first addition in the growth phase (at 75° C.). The resulting emulsion contained tabular grains having an average ECD of 0.777 μm, an average thickness of 0.144 μm and an average aspect ratio of 5.40. The emulsion parameters are listed in table 1.

Example 8

(Inventive example): High bromide {111} tabular Grain Emulsions for Photographic Application Emulsion A was prepared as described above. To emulsion A was added 6 ml of 0.1 M of 2-Iodoacetamide solution before the nucleation and 30 ml of 2-Iodideacetamide solution before the first addition in the growth stage (at 75 degrees C.).

The resulting emulsion contained tabular grains having an average ECD of 0.747 μm, an average thickness of 0.121 μm and an average aspect ratio of 6.17. The emulsion parameters are listed in table 1.

Example 9

(Inventive Example): High Bromide {111} Tabular Grain Emulsions for Photographic Application Emulsion A was prepared as described above. To emulsion A was added 15 ml of 0.1 M of 2-Iodoacetamide solution before the nucleation. The resulting emulsion contained tabular grains having an average ECD of 0.780 μm, an average thickness of 0.117 μm and an average aspect ratio of 6.65. The emulsion parameters are listed in table 1.

Example 10

(Inventive Example). High Bromide {111} Tabular Grain Emulsions for Photographic Application Emulsion A was prepared as described above. To emulsion A was added 16 ml of 0.0375 M of Iodoacetic acid solution after the nucleation and 45 ml 0.1 M Iodoacetic acid solution before the first addition in the growth phase (at 75 degrees C.).

The resulting emulsion contained tabular grains having an average ECD of 0.817 μm, an average thickness of 0.142 μm and an average aspect ratio of 5.75. The emulsion parameters are listed in table 1.

Example 11

(Inventive Example): High Bromide {111} Tabular Grain Emulsions for Photographic Application Emulsion A was prepared as described above. To emulsion A was added 15 ml of 0.1 M of Iodoacetic acid solution before the nucleation. The resulting emulsion contained tabular grains having an average ECD of 0.918 μm, an average thickness of 0.131 μm and an average aspect ratio of 7.00 The emulsion parameters are listed in table 1.

the growth stages. The pBr of the reaction mixture varied during the different growth phases between 1.92 and 2.20.

In order to carry out the iodide releasing process the temperature was lowered to 40 degrees C. in 30 minutes. In succession 138 ml of 0.435 M 2-Iodoacetamide solution, 22 ml of 1.0 M sodium hydroxide and 60 ml of 0.84 M of sodium sulfite were added to the reaction mixture. During this Iodide releasing part first the 2-Iodoactamide will be added thereafter the pH will be increased together with the sodium sulfite this will stimulate the release of the Iodide group. Due to the $Ag^+$(aq) present in the reaction mixture the released Iodide will form silver iodide layers onto the grains. Direct after the Iodide releasing part, 2-Iodoacetamide is no longer present in the reaction mixture.

The temperature was increased to 55 degrees C. and 0.43 mole of silver nitrate and 0.33 mole of potassium bromide were added during two different growth additions. The

TABLE 1

| Emulsion | Tabular grain growth modifier | mmole GGM added* before nucl. | after nucl. | before growth | mmole GGM/ mole silver | Average (11 l) tabular grain dimensions (μm) ECD × t | Aspect Ratio | Increase of aspect ratio vs. Control A |
|---|---|---|---|---|---|---|---|---|
| Control A | — | — | — | — | — | 0.670 × 0.149 | 4.50 | — |
| Example 1 | 2-Iodoacetamide | — | 0.2 | 3.0 | 2.7 | 0.809 × 0.127 | 6.37 | 41% |
| Example 2 | 2-Iodoacetamide | — | 0.6 | 3.0 | 3.1 | 0.798 × 0.116 | 6.88 | 53% |
| Example 3 | 2-Iodoacetamide | — | 0.6 | 18.0 | 16.0 | 0.789 × 0.112 | 7.00 | 56% |
| Example 4 | 2-Iodoacetamide | — | 0.6 | 56.0 | 49.4 | 0.773 × 0.121 | 6.39 | 42% |
| Example 5 | 2-Iodoacetamide | — | — | 48.0 | 41.0 | 0.841 × 0.128 | 6.57 | 46% |
| Example 6 | 2-Chloroacetamide | — | 0.6 | 18.0 | 16.0 | 0.796 × 0.148 | 5.37 | 20% |
| Example 7 | 2-Bromoacetamide | — | 0.6 | 18.0 | 16.0 | 0.777 × 0.144 | 5.40 | 20% |
| Example 8 | 2-Iodoacetamide | 0.6 | — | 3.0 | 3.1 | 0.747 × 0.121 | 6.17 | 37% |
| Example 9 | 2-Iodoacetamide | 1.5 | — | — | 1.3 | 0.780 × 0.117 | 6.65 | 47% |
| Example 10 | Iodoacetic acid | — | 0.6 | 3.0 | 3.1 | 0.817 × 0.142 | 5.75 | 28% |
| Example 11 | Iodoacetic acid | 1.5 | — | — | 1.3 | 0.918 × 0.131 | 7.00 | 56% |

*In the left column the number of mmole growth modifier added before the nucleation is given in the middle column the number of mole GGM added after nucleation is given and in the right column the number of mmole GGM before the growth phase is given.

Conclusions from table 1:

Additions of 2-Iodoacetamide and Iodoacetic acid have bigger effects on the aspect ratio than additions of 2-Bromo-acetamide and 2-Chloroacetamide Iodoacetic acid is the most suitable GGM when added before nucleation and 2-Iodoacetamide is the most suitable tested GGM when added after nucleation and before the growth stage.

Emulsion B. Tabular AgBrI Grain Emulsion

"Combination of grain growth modifier and iodide releaser"

A stirred reaction vessel contained 1200 ml of water, 2.25 ml of 3.36 M potassium bromide solution and 2 g of gelatine. The solution was maintained at a temperature of 40 degrees C. To this solution a 0.29 M silver nitrate solution and a 0.224 M potassium bromide solution were added at addition rates of 51.6 ml/min and 79.6 ml/min. The addition time of the silver nitrate solution was 58 seconds and was started and ended three seconds before the addition of the potassium bromide solution. Thereafter, 9.50 ml of a 3.36 M potassium bromide solution was added to the reaction mixture. The temperature was increased in 30 minutes to 75 degrees C. and after 15 minutes 42 g of non oxidised gelatine was added. 1.17 mole of silver nitrate, 1.18 mole of potassium bromide and 27 mmole of potassium iodide was added during three different growth additions The addition rates of all additions were so that no re-nucleation occurred during addition rates of the two additions were so that no re-nucleation occurred during the growth stages. The pBr of the reaction mixture varied during the two growth stages between 3.50 and 3.65.

The grains were washed to remove the excess of salts and gelatine. After washing 73 g of gelatine was added to the emulsion and the emulsion was stored at 6 degrees C. An $AgBr_{95}I_5$ emulsion grain results from this preparation Control Test B:(Comparative Example): High Bromide {111} Tabular Grains Emulsion for Photographic Application Emulsion B was prepared as described above.

The resulting emulsion contained tabular grains having an average ECD of 1.52 μm, an average thickness of 0.121 μm and an average aspect ratio of 12.6.

Example 12

(Inventive Example): High Bromide {111} Tabular Grain Emulsion for Photographic Application Emulsion B was prepared as described above. To emulsion B was added 2.0 ml of 0.435 M 2-Iodoacetamide solution before the first addition in the growth phase (at 75° C.).

During the Iodide releasing part at 40 degrees C., 136 ml of 0.435 M 2-Iodoacetamide solutions was added (instead of the 138 ml as in the control test). The resulting emulsion contained tabular grains having an average ECD of 1.61 μm, an average thickness of 0.105 μm and an average aspect ratio of 15.3. The emulsion parameters are listed in table 2.

Example 13

(Inventive Example): High Bromide {111} Tabular Grain Emulsion for Photographic Application Emulsion B was prepared as described above To emulsion B was added 2.0 ml of 0.435 M 2-Iodoacetamide solution before the first addition in the growth phase (at 75° C.) and 1.5 ml of 0.435 M 2-Iodoacetamide solution after the Iodide releasing part and before the fourth growth stage (at 55° C.).

During the Iodide releasing part at 40 degrees C., 136 ml of 0.435 M 2-Iodoacetamide solutions was added (instead of the 138 ml as in the control test). The resulting emulsion contained tabular grains having an average ECD of 1.67 μm, an average thickness of 0.096 μm and an average aspect ratio of 17.4. The emulsion parameters are listed in table 2.

Example 14

(Inventive Example): High Bromide {111} Tabular Grain Emulsion for Photographic Application Emulsion B was prepared as described above. To emulsion B was added 0.5 ml of 0.435 M 4-Iodobutyric acid solution before the first addition in the growth phase (at 75° C.). During the Iodide releasing part at 40 degrees C, 137.50 ml of 0.435 M 2-Iodoacetamide solution was added (instead of the 138 ml as in the control test). The resulting emulsion contained tabular grains having an average ECD of 1.54 μm, an average thickness of 0.116 μm and an average aspect ratio of 13.3. The emulsion parameters are listed in table 2.

Example 15

(Reference Example): High Bromide {111} Tabular Grain Emulsion for Photographic Application Emulsion B was prepared as described above. To emulsion B was added 0.5 ml of 0.435 M 6-Iodohexanoic acid solution before the first addition in the growth phase (at 75° C.). During the Iodide releasing part at 40 degrees C., 137.50 ml of 0.435 M 2-Iodoacetamide solution was added (instead of the 138 ml as in the control test). The resulting emulsion contained tabular grains having an average ECD of 1.48 μm, an average thickness of 0.186 μm and an average aspect ratio of 10.8. The emulsion parameters are listed in table 2.

Example 16

(Inventive Example): High Bromide {111} Tabular Grain Emulsion for Photographic Application Emulsion B was prepared as described above. To emulsion B was added 0.5 ml of 0.43 M meso-2.5-Diiodoadipic acid solution before the first addition in the growth phase (at 75° C.), During the Iodide releasing part at 40 degrees C., 137.50 ml of 0.435 M 2-Iodoacetamide solution was added (instead of the 138 ml as in the control test).

The resulting emulsion contained tabular grains having an average ECD of 1.52 μm, an average thickness of 0.118 μm and an average aspect ratio of 12.9. The emulsion parameters are listed in table 2.

Example 17

(Reference Example): High Bromide {111} Tabular Grain Emulsion for Photographic Application Emulsion B was prepared as described above. To emulsion B was added 2.0 ml of 0.435 M acetamide solution before the first addition in the growth phase (at 75° C.). The resulting emulsion contained tabular grains having an average ECD of 1.52 μm, an average thickness of 0.122 μm and an average aspect ratio of 12.6. The emulsion parameters are listed in table 2.

TABLE 2

| Emulsion | grain growth modifier | mmole GGM/mole silver | mmol Iodide releaser (2-Iodoacetamide) | Solubility of GGM-compound in water (in mmole/liter) | Average tabular grain dimension (μm) ECD × t | Aspect ratio |
|---|---|---|---|---|---|---|
| Control B | — | — | 60 | — | 1.52 × 0.121 | 12.6 |
| 12 (inv) | 2-Iodoacetamide | 0.87 | 59.13 | 950 | 1.61 × 0.105 | 15.3 |
| 13 (inv) | 2-Iodoacetamide | 0.87 + 0.65 | 58.47 | 950 | 1.67 × 0.096 | 17.4 |
| 14 (inv) | 4-Iodobutyric acid | 0.22 | 59.78 | 50 | 1.54 × 0.116 | 13.3 |
| 15 (ref) | 6-Iodohexanioc acid | 0.22 | 59.78 | 3 | 1.48 × 0.136 | 10.8 |
| 16 (inv) | meso-2,6-Diiodoadipic acid | 0.22 | 59.78 | 12 | 1.52 × 0.118 | 12.9 |
| 17 (ref) | acetamide | 0.87 | 60 | >950 | 1.52 × 0.122 | 12.6 |

Conclusions:

2-Iodoacetamide is most suitable as growth modifier (example 12 and 13 and table 2).

Addition of the 2-Iodoacetamide after the Iodide releasing step (no 2-Iodoacetamide is then present in the reaction mixture) increased the aspect ratio of the tabular grains (example 13 as compared to example 12). Thus the GGM will increase the aspect ratio during every growth stage. 2-Iodoacetamide can be used as growth modifier but if the Iodide is released there is no growth modifier activity left (see also example 17). During the Iodide releasing part the aspect ratio is not increased only a silver iodide layer is homogeneously formed onto the grain surface.

Addition of acetamide (example 17) did not gave any growth modifier activity. This implies that the halide group (in this case the Iodide) is necessary for the grain growth modifier. Molecules that have released their Iodide group have no growth modifier activity.

Decreasing the solubility of the grain growth modifiers (table 2) resulted in a smaller increase of the aspect ratio (table 2 and examples 12–16).

Decreasing the solubility of the grain growth modifier below 4 mmole/liter will have a negative effect on the relative average aspect ratio of the tabular grains (see example 15). It will decrease the average aspect ratio as compared to the control test. Also the desorption of the grain growth modifier from the grains is less, which will negatively influence the photographic properties. The amount added of the poorly soluble GGM's (4-Iodobutyric acid, 6-Iodohexanioc acid and meso-2, 5-dilodoadipic acid) is optimised. Increasing the amount of the poorly soluble GGM's gave re-nucleation resulting into an emulsion with less and thicker tabular grains.

Emulsion C. Non Monodisperse Tabular AgBr Grain Emulsion

A stirred reaction vessel contained 1050 ml of water, 93.5 ml of 3.36 M potassium bromide solution, 43 g of gelatine and a 67 g emulsion of gelatine and silver bromide seed crystals (ECD of the seed crystals is 0.35 μm and a thickness 0.050 μm) with a pBr of 1.04. The temperature of the reaction mixture was increased from 50 to 75 degrees C. To the mixture a 1.89 M silver nitrate solution was added at a start flow of 6.0 ml/min and simultaneously a solution containing 1.67 M potassium bromide and 0.045 M potassium iodide was added at a start flow 6.8 ml/min.

The flow rate of the additions was linearly increased with 0.145 ml/min for the silver solution and 0.217 ml/min for the halide solution. The additions are stopped after. 50 minutes. Thereafter, the pBr of the reaction mixture was increased to 2.45 with an addition of a 1.89 M silver nitrate solution with a flow rate of 13.6 ml/min for 11 min. The temperature was decreased to 55 degrees C. and the pBr adjusted to 2.1 and kept constant during the next two addition. During these additions 0.80 mole silver nitrate was added.

The grains were washed to remove the excess of salts and gelatine. After the washing 75 g of gelatine was added to the emulsion and the emulsion was stored at 6 degrees C. An $AgBr_{97}I_3$ emulsion grain resulted from this preparation.

Control Test C (Comparative Example): High Bromide {111} Tabular Grain Emulsions for Photographic Application Emulsion C was prepared as described above.

The resulting emulsion contained tabular grains having an average ECD of 1.8 μm, an average thickness of 0.30 μm and an average aspect ratio of 6. The emulsion parameters are listed in table 3.

Example 18

(Inventive Example): High Bromide {111} Tabular Grain Emulsions for Photographic Application Emulsion C was prepared as described above. To emulsion C was added 16 ml of 0.1125 M of 2-Iodoacetamide solution after the nucleation and 45 ml 0.1 M of 2-Iodoacetamide solution before the first addition in the growth phase (at 75° C.). The resulting emulsion contained tabular grains having an average ECD of 2.0 μm, an average thickness of 0.28 μm and an average aspect ratio of 7. The emulsion parameters are listed in table 3.

TABLE 3

| Emulsion | Growth modifier | Average {111} tabular dimensions (μm) | ECD of the 20% largest grains (μm) | ECD of the 20% smallest grains (μm) |
|---|---|---|---|---|
| Control C | — | 1.8 × 0.30 | 7.50–3.0 | 1.1–0.70 |
| Example 18 | 2-Iodoacetamide | 2.0 × 0.28 | 3.75–2.5 | 1.5–1.10 |

conclusion of table 3:

Decreasing the pBr (increasing the bromide concentration) of the reaction mixture leads usually to tabular grains with higher aspect ratio however with a broader size distribution. In case the invented GGM is added, the mono-dispersity is improved.

AgCl Grain Emulsions

Example 19

Comparative Example

To a stirred reaction vessel containing 2.5 ml of a 10% by weight gelatine solution in water are added simultaneously: 1.0 ml of a 2.0 M silver nitrate solution and 2.0 ml of a 2.0 M sodium chloride solution at a temperature of 35 degrees C. The temperature of the mixture is increased to 70 degrees C. and is further stirred for 5 hours. The grains formed are purely cubic.

Example 20

Inventive Example

To a stirred reaction vessel containing 2.5 ml of a 10% by weight gelatine solution in water and 0.5 mole/l 2Iodoacetamide are simultaneously added at a high flow rate of 80 ml/min.: 1.0 ml of a 2.0 M silver nitrate solution and 2.0 ml of a 2.0 M sodium chloride solution at a temperature of 35 degrees C. The temperature of the mixture is increased to 70 degrees C. and is further stirred for 5 hours.

The grains formed are, octahedral and {111} tabular grains. The tabular grains cover at least 70% of the total surface area.

Example 21

Inventive Example

To a stirred reaction vessel containing 2.5 ml of a 10% by weight gelatine solution in water and 0.5 mole/l 2-Iodoacetamide are simultaneously added at a very low flow rate of 10 ml/min.: 1.0 ml of a 2.0 M silver nitrate solution and 2.0 ml of a 2.0 M sodium chloride solution at a temperature of 35 degrees C. The temperature of the mixture is increased to 70 degrees C. and is further stirred for 5 hours.

The grains formed are, octahedral and {111} tabular grains. The octahedral grains cover at least 85% of the total surface area

What is claimed is:

1. A method for producing a silver halide photographic emulsion comprising the step of reacting a water-soluble silver salt and at least one water-soluble halide salt containing chloride or bromide in aqueous solution with a pH of from 3 to 7, in the presence of an organic Grain Growth Modifier (GGM) compound, wherein said grain growth modifier containing a halide X, which halide is not released in the form of an ion, to form light-sensitive silver halide grains, said grain growth modifier compound being water-soluble with a solubility>4 mmole per litre, and being selected from the group of compounds with an aliphatic or cyclo-aliphatic backbone R to which is attached one or more halide groups and at least one polar group.

2. A method according to claim 1, wherein said silver halide grains have a silver chloride content of at least 50 mole %, and wherein said silver halide grains are octahedral grains, tetra decahedral grains or tabular grains wherein at least 30% of the surface area of said light-sensitive silver halide grains is composed of {111} planes.

3. A method according to claim 2, wherein said silver halide grains have a silver chloride content of at least 70 mole %.

4. A method according to claim 1, wherein the GGM compound is represented by formulae (I) or (II):

$$(RX_n)Y_m \quad \text{(I)}$$

$$(Y_pRX_n)Z(Y_qRX_r) \quad \text{(II)}$$

wherein R is a hydrocarbon backbone to which is attached one or more halide $X_n$-groups (n=1, 2, 3, or 4 and r=1, 2, 3, or 4), and wherein the other atoms or groups attached to the backbone are freely chosen, with the proviso, that for formula (I) at least one polar $Y_m$-group (m=1, 2, or 3) is attached to the backbone, and for formula (II) the two hydrocarbon backbones R are attached by one polar group Z, whereas optionally to each hydrocarbon backbone at least one polar $Y_p$-, $Y_q$-group (p=0,1, or 2 and q=0,1, or 2) can be attached.

5. A method according to claim 4, wherein said compound represented by formulae (I) or (II) is present in an amount of from 0.01 to 3 mole per mole of silver halide contained in said emulsion during the grain making process.

6. A method according to claim 4, wherein said compound represented by formulae (Ior (II) is present in an amount of from 0.05 to 2 mole per mole of silver halide contained in said emulsion during the grain making process.

7. A method according to claim 4, wherein said compound represented by formulae (I) or (II) is present in an amount of from 0.005 to 500 mmole per mole of silver halide contained in said emulsion during the grain making process.

8. A method according to claim 4, wherein said compound represented by formulae (I) or (II) is present in an amount of from 0.05 to 100 mmole per mole of silver halide contained in said emulsion during the grain making process.

9. A method according to claim 4, wherein said silver halide grains have a silver bromide content of at least 70 mole %.

10. A method according to claim 4, wherein said silver halide grains have a silver bromide content of at least 90 mole %.

11. A method according to claim 4, wherein said silver halide grains have a silver chloride content of at least 90 mole %.

12. A method according to claim 1, wherein the substituted halide X is chloride, bromide, iodide, or any mixture of these components; the substituted polar group Y is —$CONH_2$, —COOH, —$COSO_2$, —$COSO_3H$, —COH, —CONHOH, —CN, —SCN, —$CONO_2$, —COSH, —$COSO_2NH_2$ or —$COCH_3$ groups; and the polar group Z is —(O═C)—O—(C═O)—, —(C═N)—, —O—, —(C═O)— —(C═NH)—or —(CH—$NH_2$)—.

13. A method according to claim 1, wherein said halide X is bromide or iodide; and said polar group is —$CONH_2$, or —COOH.

14. A method according to claim 1, wherein said halide X is iodide.

15. A method claim 1, wherein said backbone R is an alkyl group.

16. A method according to claim 1, wherein said aqueous solution contains 0.05 to 5.0 mole/litre of bromide at the time of forming nuclei of high bromide silver halide grains, and during the growth of said silver halide grains the concentration of bromide is at most 5.0 mole/litre, wherein said silver halide grains are tabular grains.

17. A method according to claim 1, wherein said aqueous solution contains 0.07 to 2.0 mole/litre of bromide at the time of forming nuclei of high bromide silver halide grains, and during the growth of said silver halide grains the concentration of bromide is at most 2.0 mole/litre, wherein said silver halide grabs are tabular grains.

18. A method according to claim 1, wherein said aqueous solution contains 0.05 to 5.0 mole/litre of chloride at the time of forming nuclei of high chloride silver halide grains, and during the growth of said silver halide grains the concentration of chloride is at most 5.0 mole/litre, wherein said silver halide grains are tabular grains.

19. A method according to claim 1, wherein said aqueous solution contains 0.07 to 2.0 mole/litre of chloride at the time of forming nuclei of high chloride silver halide grains, and during the growth of said silver halide grains the concentration of chloride is at most 2.0 mole/litre, wherein said silver halide grains are tabular grains.

20. A method according to claim 1, wherein said aqueous solution contains 0.05 to 2.0 mole/litre of chloride at the time of forming nuclei of high chloride silver halide grains, and during the growth of said silver halide grains the concentration of chloride is at most 2.0 mole/litre, wherein said silver halide grains are octahedral grains.

21. A method according to claim 1, wherein the grain growth modifier compounds containing the iodide-ion as halide ion are applied as iodide-ion-releasing compounds during, after, or a combination thereof the grain making process, by adding a nueleophilic agent as iodide releasing agent.

22. A method according to claim 21, wherein said nucleophilic agent is selected from the group consisting of: a hydroxide ion, a sulfite ion, hydroxylamine, a thiosulfate ion, a metabisulfite ion, hydroxamic acids, oximes, dihydroxybenzenes, mercaptans, sulfinic acids, carboxylic acids, ammonia, amines, alcohols, ureas, thioureas, phenols, hydrazides, semicabazides, phosphines and sulfides.

23. A method according to claim 21, wherein said nucleophilic agent is sulfite.

24. A method according to claim 21, wherein said iodide-ion-releasing compound is present after the grain making process in an amount of from 1 to 200 mmole per mole of silver halide contained in said emulsion.

25. A method according to claim 1, wherein said silver halide grains have a silver bromide content of a least 50 mole %, and wherein said silver halide grains are tabular grains wherein at least 70% of the surface area of said light-sensitive silver halide grains is composed of {111} planes.

* * * * *